United States Patent [19]

Wolf et al.

[11] Patent Number: 5,076,432

[45] Date of Patent: Dec. 31, 1991

[54] COMBINATION PACKAGE AND POINT-OF-PURCHASE DISPLAY

[75] Inventors: Kurt Wolf, Evanston; Frank Carlson, Worth, both of Ill.; Ann Gildea, Boston, Mass.; Barry Cohen, Buffalo Grove, Ill.

[73] Assignee: Wilton Industries, Inc., Woodridge, Ill.

[21] Appl. No.: 580,164

[22] Filed: Sep. 10, 1990

[51] Int. Cl.[5] ..... B65D 75/00

[52] U.S. Cl. ..... 206/449; 206/45.14; 206/454; 206/806

[58] Field of Search ..... 206/44 R, 45.14, 45.19, 206/449, 454, 806; 229/166, 167

[56] References Cited

U.S. PATENT DOCUMENTS

| | | | |
|---|---|---|---|
| 2,980,309 | 4/1981 | Papas | 206/45.14 |
| 3,389,785 | 6/1968 | Lidgard | 206/45.19 |
| 3,389,786 | 6/1968 | Lidgard | 206/45.14 |
| 3,655,034 | 4/1972 | Stollman et al. | 206/454 |
| 4,479,318 | 10/1984 | Russell | 206/454 |

*Primary Examiner*—Jimmy G. Foster
*Attorney, Agent, or Firm*—James P. Ryther

[57] ABSTRACT

A combination of a product and a package and point-of-purchase display unit for the product. The package and display unit includes a border section surrounding a centrally located wall section which serves as a supporting surface for the product. Retainer means which are preferably transparent are connected to the central wall section with legs defined by the retainer means being received in openings defined by the central wall section for securing the retainer means to the central wall section. The retainer means define an overlapping section located between the legs with this overlapping section being spaced from the central wall section. A corner or other part of the product being displayed is received between the surface and the overlapping section for achieving retention of the product on the surface while this part of the product remains visible when the retainer means are transparent.

24 Claims, 6 Drawing Sheets

COMBINATION PACKAGE AND POINT-OF-PURCHASE DISPLAY

BACKGROUND OF THE INVENTION

This invention relates to a package and point-of-purchase display unit combined with a product to be displayed. The invention may be employed in conjunction with a variety of different products, for example, in conjunction with a picture frame.

It has always been highly desirable to provide attractive means for packaging products in order to enhance customer appeal. In addition, it is most desirable to provide packaging which will serve to protect products which may include fragile parts or which could be damaged or marred in appearance if not adequately protected against rough or improper handling or against being dropped or having objects dropped on them.

Finally, it is most important to provide packaging which results in a minimum of inconvenience for a retailer. Thus, an ideal package is one where the purchaser simply needs to present the package and the associated product at a check-out station without requiring any significant additional packaging steps by a cashier or sales person.

Products such as picture frames present certain difficulties from a packaging standpoint. Thus, such products should be displayed in a fashion so that the consumer can readily see the product in an attractive setting and so that the consumer will be more likely to purchase the product. Ideally, picture frames are displayed without any conventional packaging associated therewith since, for example, locating of picture frames in a conventional box could hide appealing features or, at a minimum, require the consumer to open the box in order to view the product.

In the case of a picture frame with a glass panel, or in the case of any other fragile product, it is preferable to place the product in a package which will provide some protection. As indicated, however, this procedure can greatly detract from the point-of-purchase appeal of the product.

Where a product such as a picture frame is displayed without conventional packaging, it is necessary for a sales person or the like to wrap or otherwise protect the product after purchase. This is a time-consuming and inefficient operation, particularly where the product is at all fragile since care must be taken to avoid damage to the product during handling.

SUMMARY OF THE INVENTION

The present invention provides a combination package and point-of-purchase display unit which is ideally suited for products such as picture frames. The combination results in the product being displayed in an attractive fashion while at the same time maintaining the product in a safe condition. Furthermore, the package serves as a complete unit from the standpoint of handling during display and after purchase so that the sales person or the like is not required to take any time-consuming or inefficient steps once a purchasing decision has been made.

The particular package of the invention comprises a border section which surrounds a central wall section with the product being displayed supported on a surface of the central wall section. Retainer means which are preferably transparent are connected to the central wall section. In particular, the retainer means define legs which are received in openings formed in the central wall section for thereby securing the retainer means to the central wall section.

The retainer means define an overlapping section which is spaced away from the supporting surface of the central wall section. Parts of the picture frame or other product being displayed are received in the space defined between the overlapping section of the retainer means and the surface of the central wall section. Since the retainer means are transparent in accordance with the preferred form of the invention, the entire picture frame can be viewed by the potential purchaser. Accordingly, the combination of the invention achieves a secure and convenient package while also providing completely adequate display from the standpoint of consumer appeal.

In the case of picture frames, the particular design of the transparent retainer means may vary depending upon the particular shape of the frame. For example, the retainer means may be designed to receive corners of a rectangular picture frame or they may be designed to receive top and bottom portions of an oval picture frame.

In the case of picture frames which are designed with a pivoting stand member attached on the back of the picture frame, separate openings may be provided in the surface of the central wall section for receiving the stand member and for thereby providing additional means for securing the frame in place. The package may also include an upwardly extending suspending means whereby the unit and associated frame or other product can be located on a rack or some other convenient means for holding the unit. This arrangement provides a convenient means for display while also permitting efficient utilization of retail space.

The package is ideally formed of cardboard. Specifically, it is contemplated that cardboard blanks be employed, and that these blanks be provided with scorelines and various cutouts to achieve the resulting package. The use of a pair of blanks, one for the central wall section and one for the border section and an associated back wall, comprises the preferred arrangement.

The cutouts for the blanks specifically include cutouts designed for receiving the tab portions of the retainer means and for receiving the support means on the backside of a picture frame or the like. The scorelines formed in the other blank are provided so that the border section can be formed by folding of the blank about these scorelines. Means are also provided for interfitting and retaining the blank defining the central wall section with respect to the blank defining the border section and back wall.

DESCRIPTION OF THE PREFERRED EMBODIMENT

Figure 1:
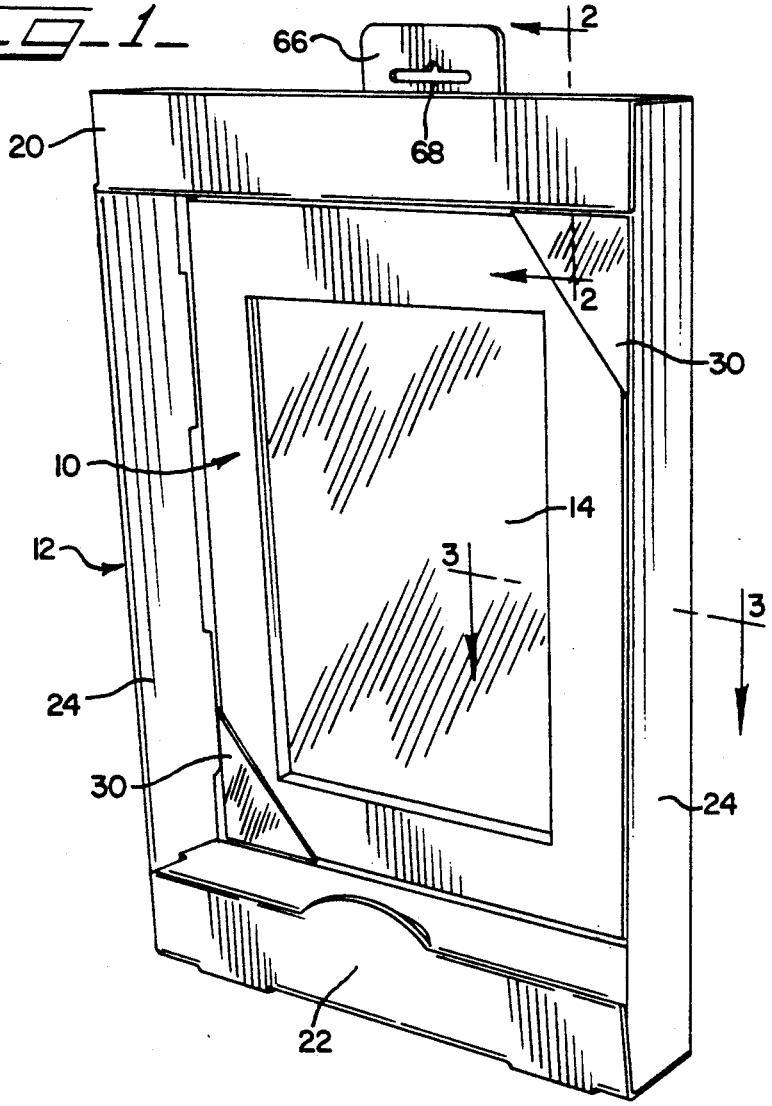
FIG. 1 is a perspective view of a first form of the product and package and point-of-purchase display unit of the invention.
Figure 10:
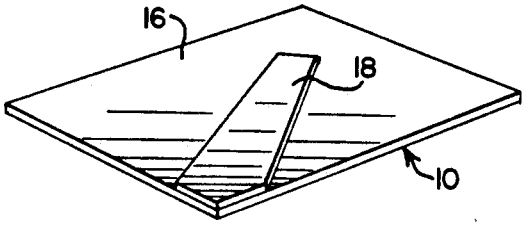
FIG. 10 is a perspective view of the back side of a picture frame adapted for use in connection with the embodiment of FIG. 1.

FIG. 1 illustrates a picture frame 10 which is mounted within a package 12. The picture frame comprises a rectangular shape having a glass or other transparent face 14 and a back wall 16 as shown in FIG. 10. The back wall 16 has a pivotable support 18 attached thereto in accordance with the conventional design of such a product.

The invention will be described in connection with picture frames; however, it will be understood that the invention is useful in connection with other products having similar characteristics. In particular, it is contemplated that the invention is useful in connection with other products sold at the retail level which would be benefitted from the provision of an efficient and attractive point-of-purchase display package.

Figure 6:
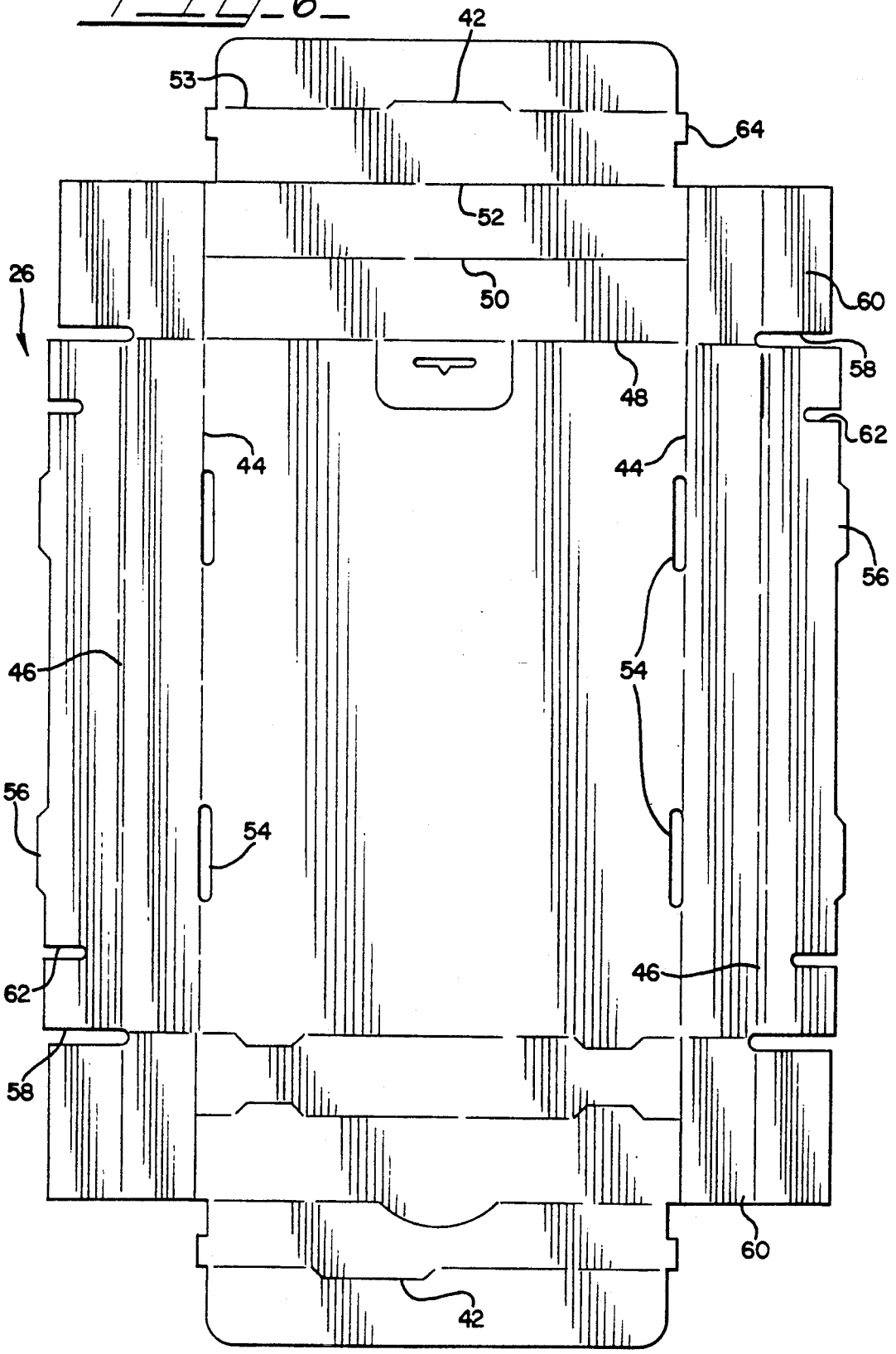
FIG. 6 is a plan view of the blank employed for providing the border and back wall sections of the invention.
Figure 7:
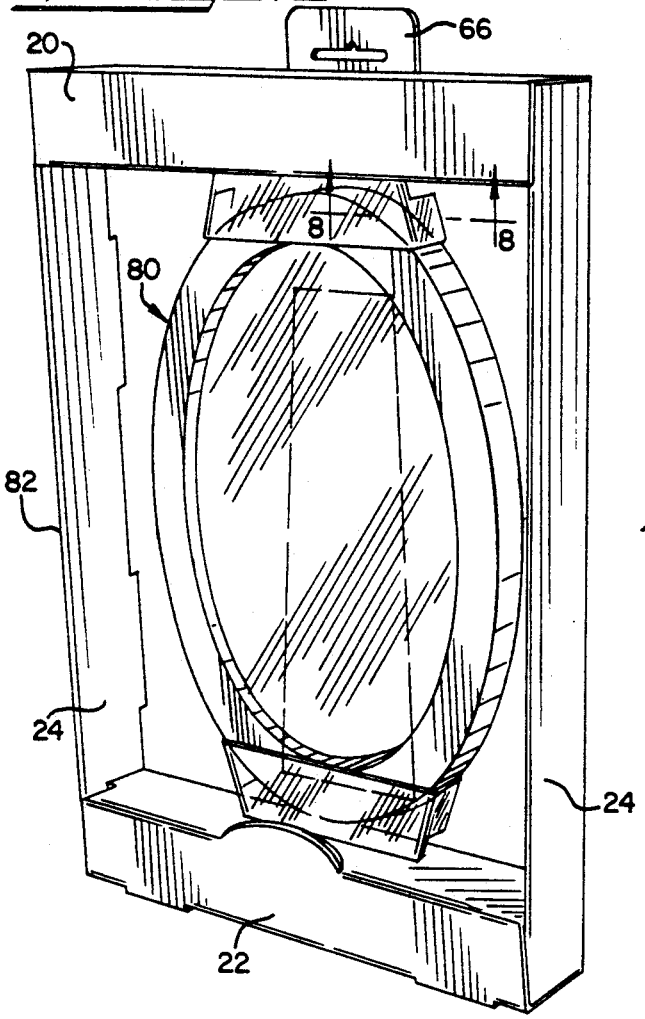
FIG. 7 is a perspective view of an alternative form of the invention.

The package 12 defines upper and lower box-shaped border sections 20 and 22. The sides 24 of the package comprise a border section formed by folded portions of the blank 26 shown in FIGS. 4 and 6.

Figure 4:
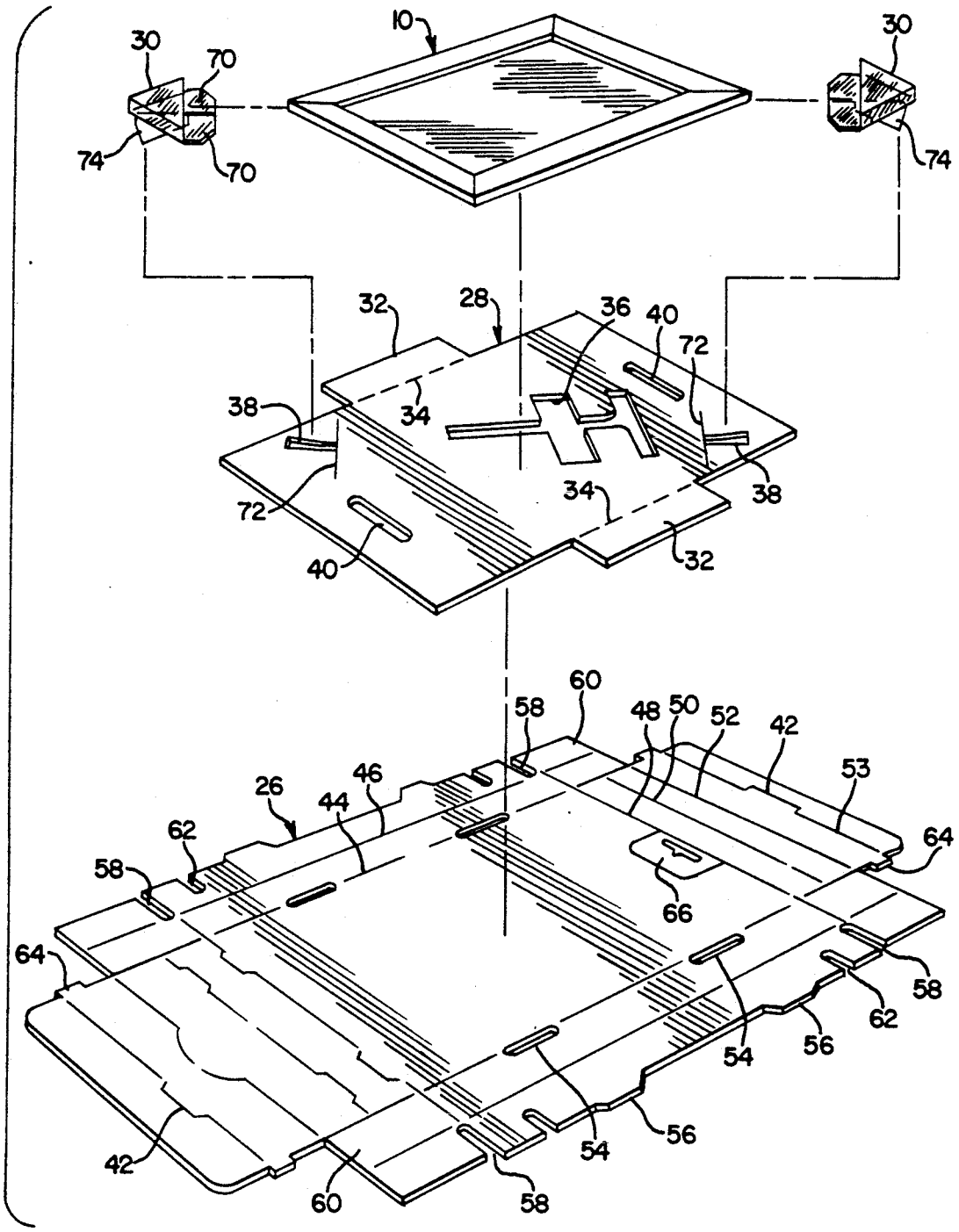
FIG. 4 is an exploded view illustrating the product, retainer means and blank sections for forming the combination of the invention.
Figure 5:
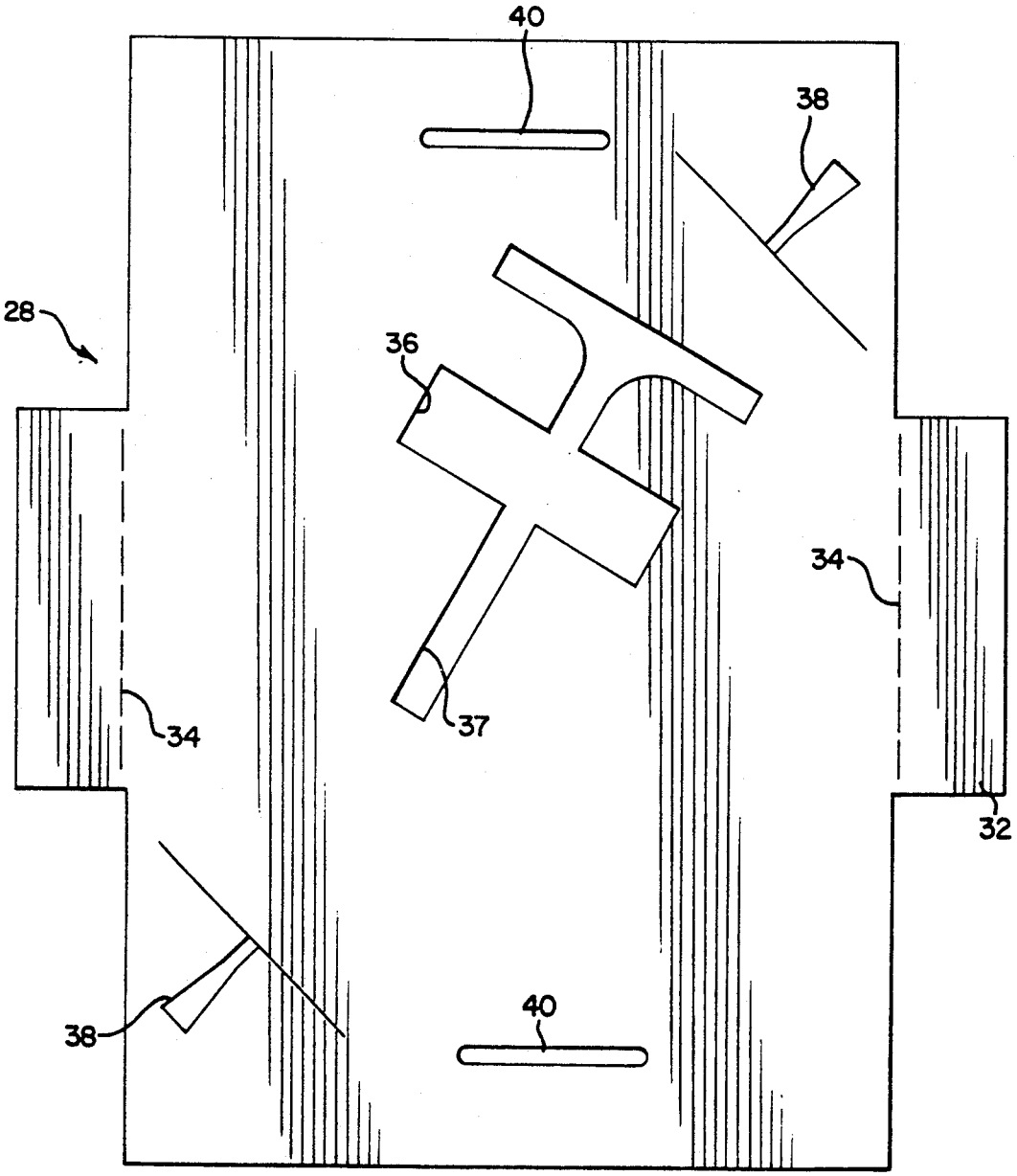
FIG. 5 is a plan view of the blank employed for providing the central wall section of the combination.

The exploded view of FIG. 4 illustrates the picture frame 10, the blank 26 and an additional blank 28. Also illustrated are retainer means 30 which are employed, as will be explained in greater detail, for holding the frame 10 in position with respect to the blank 28.

The blank 28 defines wings 32 which are adapted to be folded relative to the blank by virtue of perforations 4 formed in the blank. A first opening 36 is defined by the blank 28 for receiving the pivoting easel or support 18 of the picture frame. The shape and placement of the opening 36 will depend upon the design and placement of the easel, and many variations are possible. For example, the vertical portion 37 may accommodate a ribbon used for limiting pivoting movement of the easel. The different crosswise sections 39 and 41 will accommodate different types of easels.

Additional openings 38 are formed in the blank for receiving legs defined by the retainer means 30. Still further openings 40 are formed in the blank 28 for interfitting with extensions 42 formed in the blank 26.

The blank 26 is characterized by a plurality of scorelines including the scorelines 44 and 46 which are employed for folding of the blank to achieve the side border section 24. Additional scorelines 48, 50, 52 and 53 are formed by the blank 26 in order to achieve the top and bottom box-shaped border sections 20 and 22.

A pair of openings 54 are formed on each side of the blank 26 for interfitting relationship with extensions 56 for purposes of maintaining the side wall border section in a fixed relationship.

Cutout portions 58 are defined at each corner of the blank 26 to permit tucking of the blank corners 60 within the box-shaped border sections when the blank is folded. Additional cutouts 62 are formed adjacent the cutouts 58 for receiving extensions 64 formed in the respective border sections 20 and 22 for thereby maintaining the box-shaped configuration of these border sections.

A hanging tab 66 is adapted to be pushed outwardly relative to the blank 26 after folding thereof. The hanging tab defines an opening 68 which, as indicated in FIG. 1, may be employed for suspending the package and associated frame on a rack for display purposes.

The retainer means 30 previously described are preferably formed of transparent plastic material. The retainer means define a triangular configuration so that they are particularly suited for receiving the corners of frame 10.

Figure 2:
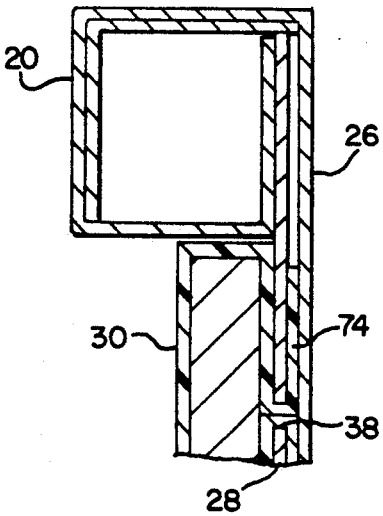
FIG. 2 is an enlarged fragmentary, cross-sectional view taken about the line 2—2 of FIG. 1.
Figure 3:
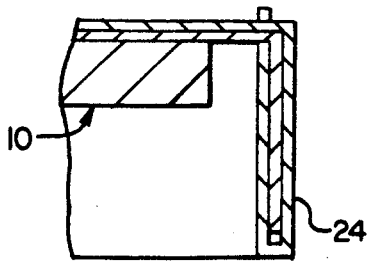
FIG. 3 is an enlarged fragmentary, cross-sectional view taken about the line 3—3 of FIG. 1.

The retainer means may be formed from flat plastic stock which is cut out and provided with scorelines to permit folding of the retainer means into the configurations shown in FIG. 4. As shown, the folded retainer means include bottom wall extensions 70 which are adapted to be pushed underneath the surface of blank 28 through slits 72 formed in this surface. A pair of wings 74 extend downwardly from the bottom wall of the respective retainer means, and these wings are received in the openings 38 defined by the blank 28. The wings are then folded outwardly into parallel relationship with the bottom surface of the blank 28. The folded wings 74 are shown in FIG. 2. Although the wings 74 can adequately serve the function of holding the retainer means in position, adhesive may be applied to secure the top surface of a wing to the bottom surface of blank 28.

In the use of the package of FIGS. I through 6, the retainer means 30 are associated with the blank 28. The blank 28 is then located in overlying relationship with respect to the blank 26, and the respective border sections are then folded into position. The picture frame is then positioned relative to the retainer means with the latter being sufficiently flexible to enable insertion of the frame. Once positioned, however, the frame is held quite securely in place so that there is no likelihood of the frame being dislodged due to handling. In addition, the package provides excellent protection for the frame during shipping, or in the event the package should be dropped during handling.

Figure 11:
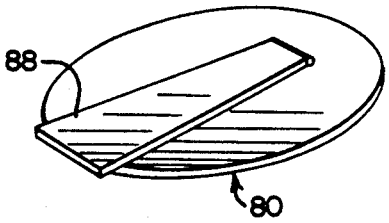
FIG. 11 is a perspective view of the back side of a picture frame adapted for use in connection with the embodiment of FIG. 7; and, FIG. 12 is a plan view of the blank employed for forming the central wall section of the combination of FIG. 7.
Figure 12:
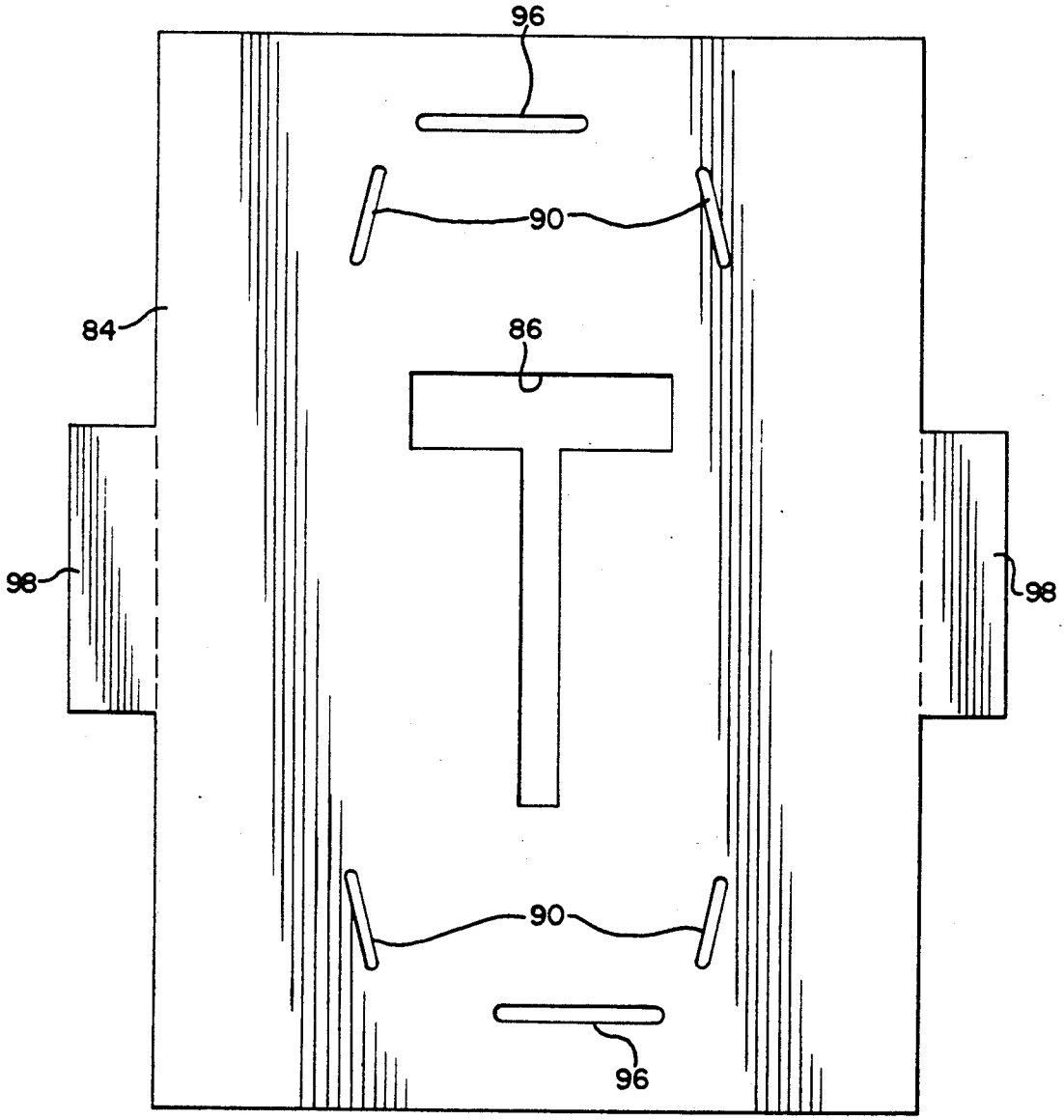

FIGS. 7 through 12 illustrate an alternative form of the invention wherein a frame 80 of oval shape is located in package 82. A blank of the same configuration as the blank 26 is employed for achieving top and bottom border sections 20 and 22 and side border sections 234. It will be appreciated in this connection that blanks of various sizes may be employed, depending upon the size and shape of the picture frame or other object to be packaged and displayed. FIG. 12 illustrates a blank 84 which is adapted for use in association with the frame 80.

In this instance, the blank includes a first opening 86 for receiving the pivoting support or easel 88 shown in FIG. 11. Additional openings 90 are formed in the blank 84 for receiving legs 92 defined by retainer means 94. Finally, openings 96 are formed in the blank 84 for interfitting with the extensions 42 in the blank 26. Wings 98 are included for interfitting with the side wall border sections 24.

Figure 8:
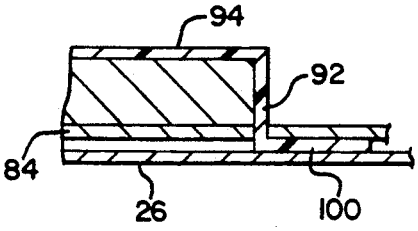
FIG. 8 is an enlarged fragmentary, cross-sectional view taken about the line 8—8 of FIG. 7.
Figure 9:
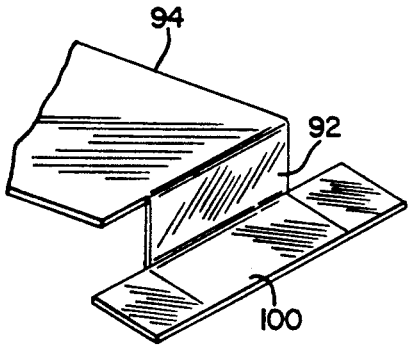
FIG. 9 is a fragmentary view of the retainer means used in conjunction with the embodiment of FIG. 7.

The retainer means 94 are preferably formed of a transparent plastic material. When the respective legs of a retainer 94 are inserted in openings 90, the retainers are held in position at the top and bottom positions of the package for receiving top and bottom portions of the frame 80. Each of the legs 92 includes feet 100 which assist in holding of the retainers in position. Specifically, as shown in FIG. 8, the feet are positioned between the bottom surface of the blank 84 and the top surface of blank 26. Adhesive may also be utilized in this case to secure the top surface of the feet 100 to the bottom surface of the blank 84.

The combination illustrated serves as a highly satisfactory means for packaging of a product such as a picture frame while at the same time providing means for attractively displaying the product. Thus, the picture frame is kept in secure fashion while the most attractive features of the frame can still be seen by a prospective purchaser. This is particularly true where transparent plastic retainers which do not hide portions of the frame are used in the combination.

Other features may be added to the combination, for example, a box cover of conventional design could be employed. Other changes may also be made in the combination disclosed without departing from the spirit of the invention, particularly as described in the following claims.

That which is claimed is:

1. The combination of a product and package and point-of-purchase display nit for the product, said display unit comprising a border section and a central wall section defining a supporting surface for said product, retainer means connected to said central wall section, legs defined by said retainer means, at least one opening defined by said central wall section, said legs being received in said opening for securing said retainer means to said central wall section, an overlapping section defined by said retainer means between said legs, said overlapping section being spaced away from said surface of said central wall section, a part of said product being displayed being received between said surface and said overlapping section for achieving retention of said product on said surface, and wherein said retainer means are formed of transparent material so that said part of the product remains visible.

2. The combination of a product and a package and point-of-purchase display unit for the product, said display unit comprising a border section and a central wall section defining a supporting surface for said product, retainer means connected to said central wall section, legs defined by said retainer means, at least one opening defined by said central wall section, said legs being received in said opening for securing said retainer means to said central wall section, an overlapping section defined by said retainer means between said legs, said overlapping section being spaced away from said surface of said central wall section, a part of said product being displayed being received between said surface and said overlapping section for achieving retention of said product on said surface, and wherein said legs comprise portions extending inwardly toward said surface from opposite ends of said overlapping section, and tab portions extending in substantially parallel relationship with said overlapping section, said tab portions being located on the side of said central wall section opposite said supporting surface.

3. The combination of claim 2 wherein said legs each include a return portion formed at the end of each of the portions extending inwardly toward said surface and extending in substantially parallel relationship with said overlapping section, the respective ends of said return portions being positioned adjacent each other, and wherein a tab portion is formed on each of the respective ends, said central section including a single opening receiving said tab portions.

4. The combination of claim 2 wherein a tab portion is formed at the end of each of the portions extending inwardly toward said surface, and wherein said central section includes a pair of spaced openings for receiving the respective tab portions.

5. The combination of claim 4 wherein said tab portions are bent outwardly with respect to each other.

6. The combination of claim 2 wherein said central section comprises a piece of material formed independently of said border section, said border section including a back wall, and wherein said central section is positioned in overlying relationship with said back wall, said tab portions being interposed between said central section and said back wall.

7. The combination of a product and a package and point-of-purchase display unit for the product, said display unit comprising a border section and a central wall section defining a supporting surface for said product, retainer means connected to said central wall section, legs defined by said retainer means, at least one opening defined by said central wall section, said legs being received in said opening for securing said retainer means to said central wall section, an overlapping section defined by said retainer means between said legs, said overlapping section being spaced away from said surface of said central wall section, a part of said product being displayed being received between said surface and said overlapping section for achieving retention of said product on said surface, and wherein said product comprises a picture frame, said picture frame including a support means on the backside thereof, and including an additional opening defined by said central section and receiving said support means.

8. The combination of a product and a package and point-of-purchase display unit for the product, said display unit comprising a border section and a central wall section defining a supporting surface for said product, retainer means connected to said central wall section, legs defined by said retainer means, at least one opening defined by said central wall section, said legs being received in said opening for securing said retainer means to said central wall section, an overlapping section defined by said retainer means between said legs, said overlapping section being spaced away from said surface of said central wall section, a part of said product being displayed being received between said surface and said overlapping section for achieving retention of said product on said surface, and wherein said product comprises a picture frame, and including a pair of spaced-apart retainer means receiving oppositely-disposed parts of said frame.

9. The combination of a product and a package and point-of-purchase display unit for the product, said display unit comprising a border section and a central wall section defining a supporting surface for said product, retainer means connected to said central wall section, legs defined by said retainer means, at least one opening defined by said central wall section, said legs being received in said opening for securing said retainer means to said central wall section, an overlapping section defined by said retainer means between said legs, said overlapping section being spaced away from said surface of said central wall section, a part of said product being displayed being received between said surface and said overlapping section for achieving retention of said product on said surface, and including means adapted to extend upwardly from a top portion of said border section for suspending of said unit for display purposes.

10. The combination of a product and a package and point-of-purchase display unit for the product, said display unit comprising a border section and a central wall section defining a supporting surface for said product, retainer means connected to said central wall section, legs defined by said retainer means, said legs comprising portions extending inwardly toward said surface from opposite ends of said overlapping section, and tab portions extending in substantially parallel relationship with said overlapping section, means including said tab portions for securing said retainer means to said central wall section, an overlapping section defined by said retainer means between said legs, said overlapping section being spaced; away from said surface of said central wall section, a part of said product being displayed being received between said surface and said overlapping section for achieving retention of said product on said surface and wherein said retainer means are formed of transparent material so that said part of the product remains visible.

11. The combination of claim 10 wherein said product comprises a picture frame.

12. The combination of claim 10 wherein said border section is formed from a cardboard blank, said blank defining score lines enabling folding of side edges thereof, the folded side edges defining a recessed area for receiving said product.

13. The combination of claim 12 wherein said blank defines a back wall, said folded side edges comprising side walls extending outwardly from said back wall.

14. The combination of claim 13 wherein said central wall section s formed from a second cardboard blank, said central wall section being disposed within said recessed area in overlying relationship with said back wall.

15. The combination of claim 14 wherein said second cardboard blank includes outwardly extending wing members, said wing members interfitting with respective folded side edges for securing said central wall section in position.

16. The combination of claim 12 wherein said first-mentioned cardboard blank includes at least one border section formed from a combination of folded strips including one strip positioned in parallel relationship with said central wall section, said one strip being adapted for the display of informational material.

17. The combination of claim 10 wherein said product comprises a picture frame.

18. The combination of claim 17 wherein said picture frame includes a support means on the backside thereof, and including an additional opening defined by said central section and receiving said support means.

19. The combination of claim 17 wherein said pair of spaced-apart retainer means receive oppositely-disposed parts of said frame.

20. The combination of claim 10 including means adapted to extend upwardly from a top portion of said border section for suspending of said unit for display purposes.

21. The combination of claim 10 wherein said border section is formed from a cardboard blank, said blank defining score lines enabling folding of said edges thereof, the folded side edges defining a recessed area for receiving said product, said blank defining a back wall, said folded side edges comprising side walls extending outwardly from said back wall, at least one extension formed along the edge of a blank portion, and an opening defined by said blank for receiving said extension when said side edges are in folded relationship for thereby holding side edges in the folded relationship.

22. The combination of claim 21 wherein said side edges include at least one border section formed from a combination of folded strips, at least one extension formed along the edge of at least one strip, and an opening defined by said blank for receiving said extension on said strip.

23. The combination of claim 22 wherein at least one strip is positioned in parallel relationship with said central wall section, said one strip being adapted for the display of informational material.

24. The combination of claim 10 wherein said central section comprises a piece of material formed independently of said border section, said border section including a back wall, and said central section being positioned in overlying relationship with said back wall.

* * * * *